US005563646A

United States Patent [19]

Fukuda

[11] Patent Number: 5,563,646

[45] Date of Patent: Oct. 8, 1996

[54] METHOD OF CLEANING THERMAL HEAD

[75] Inventor: Hiroshi Fukuda, Saitama, Japan

[73] Assignee: Fuji Photo Film Co., Ltd., Kanagawa, Japan

[21] Appl. No.: 389,000

[22] Filed: Feb. 15, 1995

[30] Foreign Application Priority Data

Feb. 17, 1994 [JP] Japan ..... 6-20385

[51] Int. Cl.[6] ..... B41J 29/17; B41J 2/32

[52] U.S. Cl. ..... 347/171; 400/702

[58] Field of Search ..... 347/171, 172, 347/173, 174, 175, 176, 177, 178, 179; 400/701, 702, 703

[56] References Cited

U.S. PATENT DOCUMENTS 4,734,704 3/1988 Mizutani et al. ..... 347/173

*Primary Examiner*—Benjamin R. Fuller
*Assistant Examiner*—L. Anderson
*Attorney, Agent, or Firm*—Birch, Stewart, Kolasch & Birch, LLP

[57] ABSTRACT

A thermal printer has a sheet cassette for containing plural stacked thermosensitive recording sheets, which are advanced one after another out of the sheet cassette toward a platen drum. During a printing step, a thermal head is pressed against a recording sheet set on the platen drum. While the recording sheet is pressed, the platen drum is moved relative to the thermal head, which thermally records an image on the recording sheet. A protective sheet for protecting the recording sheets is laid on the stacked recording sheets in the sheet cassette. The protective sheet is advanced to and set on the platen drum. The thermal head is pressed against the protective sheet. While the protective sheet is pressed, heat energy is generated through the thermal head. At the same time, the platen drum is driven for moving the protective sheet, to remove dust from the thermal head with the protective sheet.

22 Claims, 9 Drawing Sheets

METHOD OF CLEANING THERMAL HEAD

BACKGROUND OF THE INVENTION

1. Field of the Invention

The present invention relates to a method of cleaning a thermal head of a thermal printer. More particularly, the present invention relates to a method of cleaning a thermal head with great ease.

2. Description Related to the Prior Art

There are thermal transfer printers and direct thermal printers known in the art. The thermal transfer printers are classified into a thermal die sublimation transfer type and a thermal wax transfer type. The direct thermal printing is featured by low costs in operation and no creation of waste with heating of the thermosensitive material. In a direct thermal printer, a thermosensitive recording sheet is set on a periphery of a platen drum, which is rotated to move the recording sheet in a main scanning direction. During the movement of the recording sheet, a front edge of an area effective for the recording comes to lie under a thermal head. In response to this, the thermal head is swung or shifted toward the platen drum to press the recording sheet. A great number of heating elements, arranged linearly to constitute the thermal head, is driven to generate heat energy in correspondence to image data, and forms an image to the recording sheet in the effective area line after line. As soon as a rear edge of the effective area come to lie under the thermal head, the thermal head is shifted away from the recording sheet.

There is also a known color thermal printer which is used with a color thermosensitive recording sheet including a support and cyan, magenta and yellow thermosensitive coloring layers laid on the support. The thermal printer has a platen drum, which is driven to make three rotations to record the three primary colors by coloring the coloring layers in an order toward the support. In the color thermal printer, the yellow coloring layer, having received heat energy first for producing yellow color, is provided with application of ultraviolet rays peaking at a wavelength of 420 nm, for fixation of the yellow coloring layer in avoidance of receiving influence of further heat energy for the remaining coloring layer. The magenta coloring layer, having received heat energy secondly, is provided with ultraviolet rays peaking at a wavelength of 365 nm for fixation of the magenta color.

The thermal head presses the recording sheet while printing an image. It is very likely with time that the thermal head is provided with dust stuck on recording sheets, or dust derived from scratching or rubbing a protective layer on an obverse face of the recording sheet, for example dust of lubricant agent in the protective layer. The thermal head is highly susceptible to dust, dirt or other deposits.

When dust or other deposit is stuck on the thermal head, an image printed through the thermal head is degraded remarkably, because the ability of the thermal head to transmit heat is lowered. If the whole of the thermal head is coated with dust, then the density of the printed image may be lowered. If the thermal head is partially coated with dust, then the printed image may include white stripes. If the dust on the thermal head is hardened with time, then the dust may scratch recording sheets in contact. The thermal head, in the course of long use in the thermal printer, requires cleaning.

Conventionally, it is highly difficult to clean the thermal head, because the thermal printer must be disassembled to remove the thermal head. A cover of the thermal printer must be dismounted before the thermal head could be removed from a chassis of the printer.

SUMMARY OF THE INVENTION

In view of the foregoing problems, an object of the present invention is to provide a method of cleaning a thermal head with great ease.

In order to achieve the above and other objects and advantages of this invention, a thermal printer has a sheet cassette for containing plural stacked thermosensitive recording sheets. The recording sheets are advanced one after another out of the sheet cassette toward a platen. The thermal head is pressed against a recording sheet set on the platen during a printing step. While the recording sheet is pressed, the platen is moved relatively to the thermal head and the thermal head thermally records an image on the recording sheet. A protective sheet is laid on the stacked recording sheets in the sheet cassette. The protective sheet is adapted to protecting the recording sheets. The protective sheet is advanced out of the sheet cassette to the platen. The thermal head is pressed against the protective sheet set on the platen. While the protective sheet is pressed, heat energy is generated through the thermal head. While the protective sheet is pressed, the platen is driven for moving the protective sheet relatively to the thermal head, to remove dust from the thermal head with the protective sheet.

In a preferred embodiment, after recording of the image, the thermal head is moved relatively to the recording material while the thermal head is pressed against a marginal area on the recording material, where the marginal area is defined outside the effective area. The marginal area removes dust from the thermal head for cleaning the thermal head to stand by for recording an image next to be recorded.

In the present invention, it is possible to clean the thermal head with great ease. It is unnecessary to disassemble the thermal printer to clean the thermal head.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
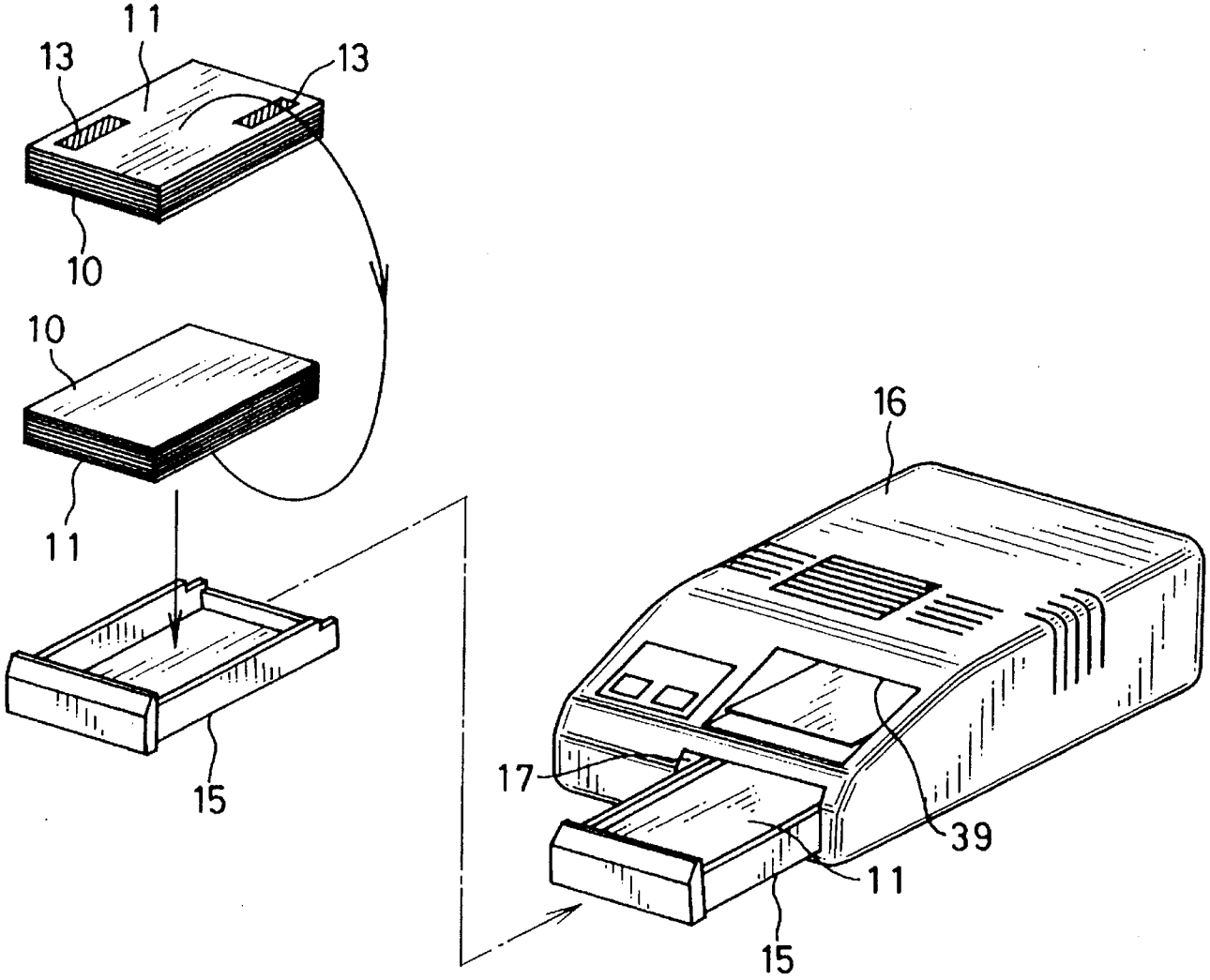
FIG. 1 is an explanatory view in perspective, illustrating a thermal printer and operation of loading the same with thermosensitive recording sheets.

In FIG. 1, plural thermosensitive recording sheets 10 are stacked together with their recordable obverse faces directed in an equal direction. A protective sheet 11 is lapped on one of the recording sheets 10 having an uncovered recordable face, for the purpose of protecting the recording sheets 10 from ambient light, moisture, and being scratched. A support included in each recording sheet 10 is formed of the same material as the protective sheet 11, for the purpose of equality in the curling tendency and the friction. The material is for example polyethylene terephthalate (PET).

The PET support of the recording sheet 10 can be white or transparent. The PET sheet for the protective sheet 11 is colored in an opaque color with small optical transmittance for providing the protective sheet 11 with a characteristic of cutting off ultraviolet rays. The recording sheet 10 has the PET support and cyan, magenta and yellow thermosensitive coloring layers formed on the support in the order listed. The coloring layers are colored in cyan, magenta and yellow by application of heat. On the yellow coloring layer, a protective layer is formed to lie as an obverse face. The protective sheet 11 is provided with discriminative marks 13 printed thereon. Although the protective sheet 11 is to be laid at a bottom in a thermal printer 16, it is possible beforehand to orient the package of the recording sheets 10 in any direction.

The protective sheet 11 is white, and has the discriminative marks 13 colored black. The discriminative marks 13 may not be black, but can have a dark color having a sufficiently low reflectance. It is possible for the discriminative marks 13 to be definitely different in density or in color from blank portions of the protective sheet 11. The discriminative marks 13 are printed on the protective sheet 11 to be rotationally symmetrical, so that the sheets 10 and 11 can be set into a sheet cassette 15 without consideration of either longitudinal direction of the sheets.

To load the thermal printer 16 with the recording sheets 10, a wrapper (not shown) is torn. All the recording sheets 10 and the protective sheet 11 are taken out, and inserted in the sheet cassette 15 to lay the protective sheet 11 at the bottom, with the coloring layers directed to the bottom. The sheet cassette 15 is set into a cassette chamber 17 in the thermal printer 16. In FIG. 1, the curved arrow is used for convenience in indicating that the protective sheet 11 initially located on the top is directed by external operation to the bottom so that the recording sheets 10 are suitably oriented.

Figure 2:
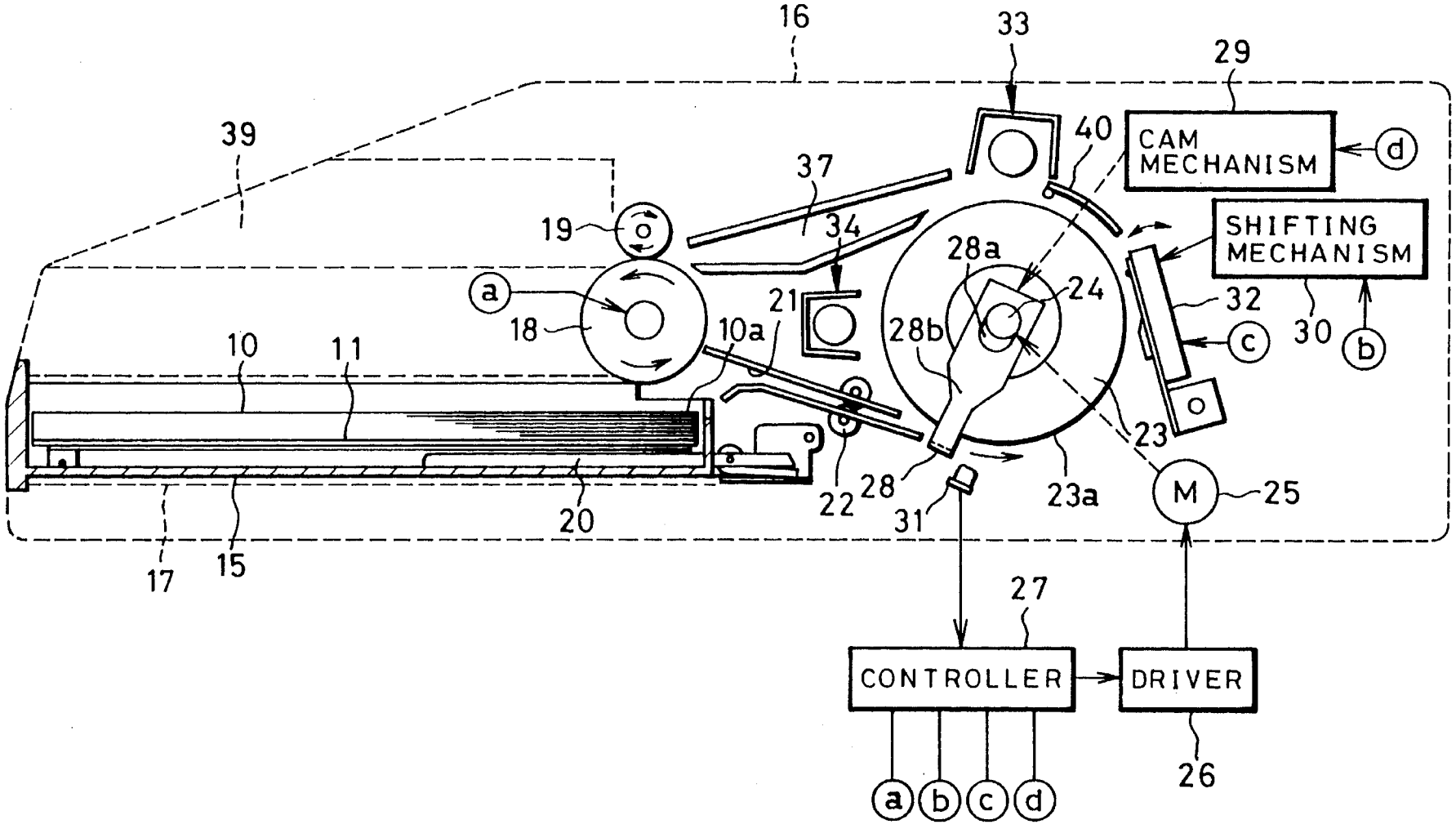
FIG. 2 is an explanatory view schematically illustrating the thermal printer of FIG. 1.

In FIG. 2, a feeding/exiting roller 18 is disposed above the cassette chamber 17. An exiting roller 19 is disposed on the feeding/exiting roller 18 to cooperate therewith. During operation of the thermal printer 16, the feeding/exiting roller 18 constantly rotates in the counterclockwise direction. A lifting lever 20 is inserted in a bottom of the sheet cassette 15. In the feeding of each sheet, the lifting lever 20 lifts an advancing edge 10*a* of the recording sheet 10, and presses the advancing edge 10*a* up against the feeding/exiting roller 18. The uppermost of the recording sheets 10 is advanced to a feeding path 21. Then the lifting lever 20 is lowered to its original position. The recording sheets 10 in the sheet cassette 15 come away from the feeding/exiting roller 18, and are kept from advancing. The exiting roller 19 is synchronized with the feeding/exiting roller 18, and operates for exiting the recording sheets 10 after the thermal recording and the fixation.

The feeding path 21 has a pair of advancing rollers 22, which feed the recording sheet 10 toward a platen drum 23. The platen drum 23 is driven by a stepping motor 25 via a platen shaft 24. The stepping motor 25 is controlled by a controller 27 through a driver 26.

A thermal head 32 is disposed to be shiftable toward and away from the platen drum 23. A shifting mechanism 30 shifts and presses the thermal head 32 against the platen drum 23 so that the recording sheet 10 is sandwiched. The thermal head 32 is driven to apply heat to the recording sheet 10 while pressed against the recording sheet 10, so as to record an image thermally.

The platen drum 23 has a dark color, and has a clamper 28 for fixing an advancing edge 10*a* of the recording sheet 10 on a peripheral face 23*a* of the platen drum 23. The clamper 28 has a light color, and is mounted about the platen shaft 24 which lies through a slot 28*a*. The clamper 28 is secured movably in a radial direction of the platen drum 23 through a cam mechanism 29.

Figure 4A:
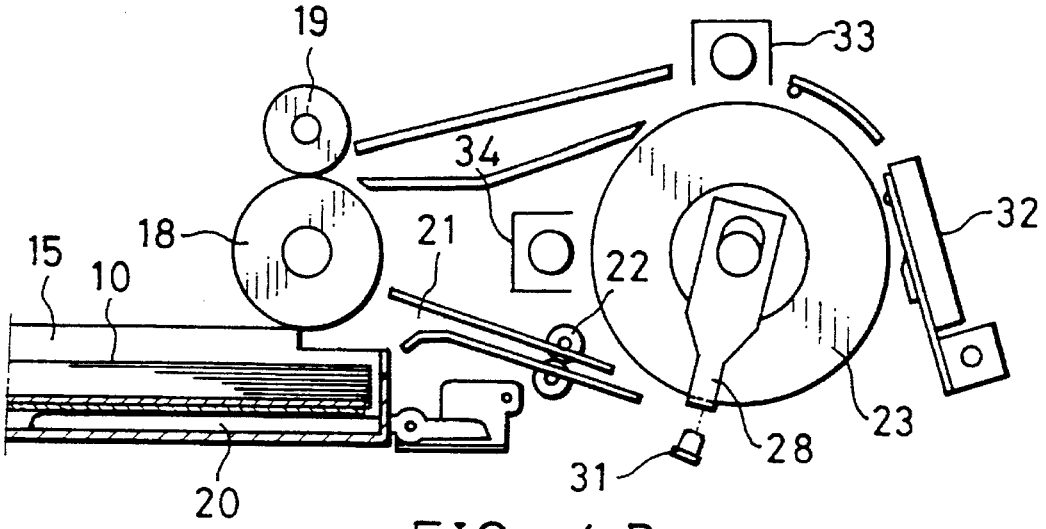
FIGS. 4A to 4C are explanatory views illustrating steps of setting a clamper, and feeding and advancing a recording sheet.

In a feeding station (See FIG. 4) and an exiting station (See FIG. 6B), the clamper 28 stands opened for feeding and exiting the sheets. In the feeding station, the clamper 28 having the open state stands by. When the advancing edge 10*a* passes through the clamper 28 to come beyond it, the cam mechanism 29 causes the clamper 28 to move to have the closed state. The recording sheet 10 is clamped. In the exiting station, the clamper 28 is opened through the cam mechanism 29. The platen drum 23 is normally rotated to exit the recording sheet 10 after recording operation at the thermal head 32.

The feeding station has a home position detecting sensor 31, which detects a home position of the clamper 28. The position sensor 31 consists of a photo sensor of a reflective type. In response to detection of the clamper 28 at the position sensor 31, the controller 27 causes the platen drum 23 to rotate in reverse and to a small extent, to set the clamper 28 exactly in the home position. The position sensor 31 is used also as a sheet sensor, and detects the advancing edge 10*a* exited from the clamper 28. While the clamper 28 is set in the home position, the advancing edge 10*a* is to be detected at the position sensor 31 upon advancement of the advancing edge 10*a* beyond the clamper 28.

The position sensor 31 is used also as protective sheet detecting sensor. When the protective sheet 11 comes to a recording station where the recording sheet 10 would stand by for the recording, the position sensor 31 detects one of the discriminative marks 13. With the discriminative mark 13 detected, the clamper 28 is opened in the exiting station. The platen drum 23 is continuously rotated. As soon as the advancing edge 10*a* comes to lie under the thermal head 32, the thermal head 32 is shifted and pressed against the protective sheet 11. With the thermal head 32 driven to generate heat, the platen drum 23 further rotates. The thermal head 32 is rubbed on and cleansed by the protective sheet 11, which is exited simultaneously.

Near to the platen drum 23, there are disposed a thermal head 32 in the recording station for the recording sheets 10, and yellow and magenta optical fixing devices 33 and 34 to lie past the recording station with reference to the normal rotational direction. The thermal head 32 has plural heating elements 32*a* (See FIG. 7) arranged linearly, and generate heat energy corresponding to density of each pixel.

The fixing devices 33 and 34 are constituted by a long box-shaped reflector extended in parallel with an axis of the platen drum 23, and a tubular ultraviolet lamp contained inside the reflector. The yellow fixing device 33 applies ultraviolet rays in a range peaking at a wavelength of 420 nm to fix the yellow coloring layer. The magenta fixing device 34 applies ultraviolet rays in a range peaking at a wavelength of 365 nm to fix the magenta coloring layer. An exit path 37 is disposed to lie past the yellow fixing device 33, and communicates with an exit port 39 for the recording sheet 10.

There is arranged a stopper 40 directly before the yellow fixing device 33. The clamper 28, when opened to unclamp the recording sheet 10, is contacted on the stopper 40, which then prevents the clamper 28 from rotating further even during the rotation of the platen drum 23. After the completion of the exit of the recording sheet 10, the clamper 28 come to have the clamping state and is unlatched from the stopper 40. Then the clamper 28 rotates with the rotation of the platen drum 23, as there is friction between the clamper 28 and the platen drum 23.

Figure 3:
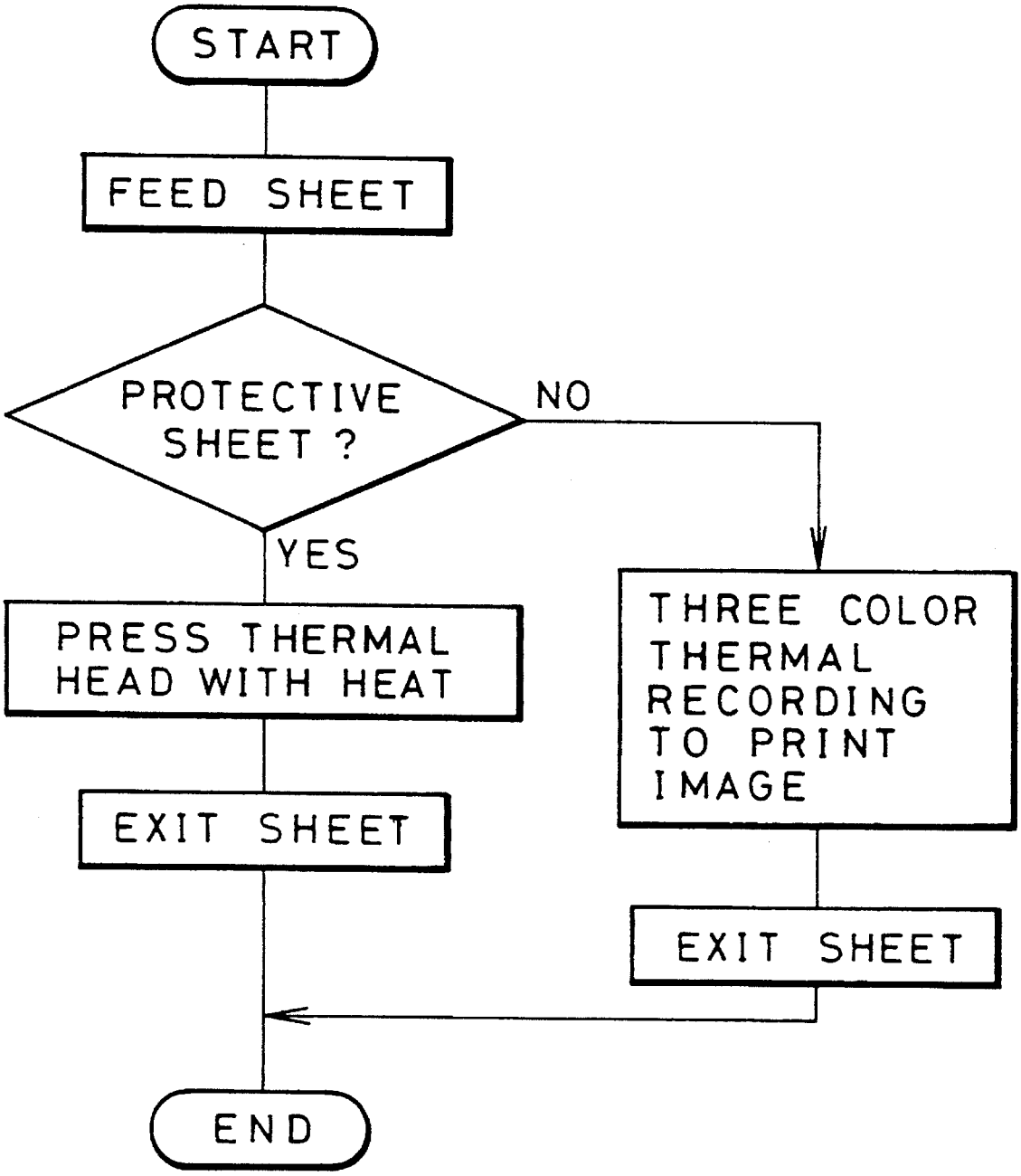
FIG. 3 is a flow chart illustrating a sequence of cleaning a thermal head with a protective sheet.

The operation of the above embodiment is described with reference to FIG. 3. At first the wrapper covering the recording sheets 10 is opened. The recording sheets 10 with the protective sheet 11 are taken out. The protective sheet 11 is laid underneath, and inserted in the sheet cassette 15 with the recording sheets 10. The sheet cassette 15 is set into the cassette chamber 17.

Figure 4B:
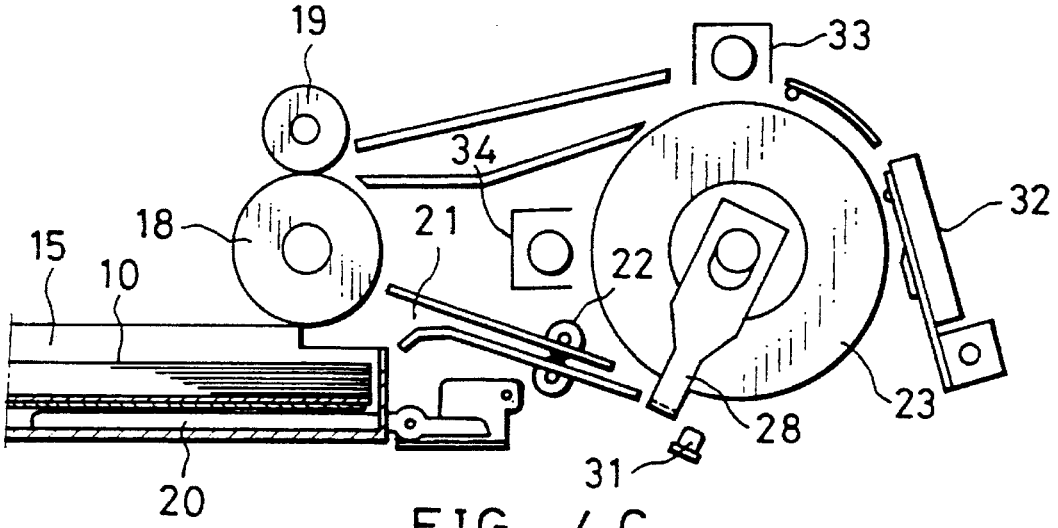

In feeding of the recording sheet 10, the platen drum 23 is rotated. The clamper 28 is moved to the position sensor 31, which is turned on thereby. The On-signal is applied to the controller 27. The controller 27, in response to the On-signal, stops the motor 25 (See FIG. 4A). The controller 27 supplies the motor 25 with drive pulses in a predetermined number, to cause the motor 25 to rotate in reverse. As illustrated in FIG. 4B, the platen drum 23, with the clamper 28, returns to a small extent. The clamper 28 is set in the home position. The clamper 28 is now retracted from the position sensor 31, which stands by for detection of the advancing edge 10*a* passed through the clamper 28. The cam mechanism 29 is actuated to open the clamper 28.

Figure 4C:
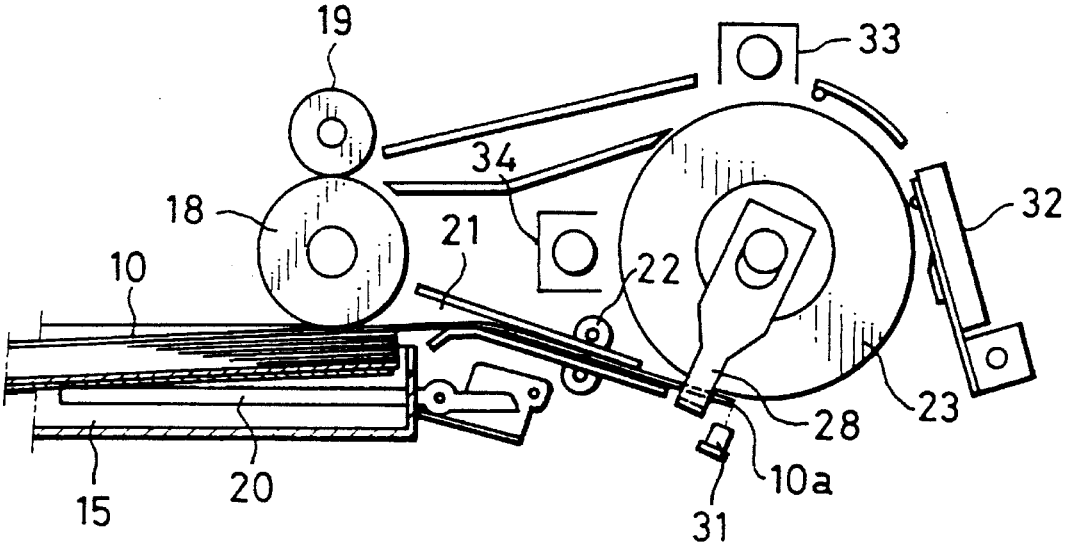
Figure 5A:
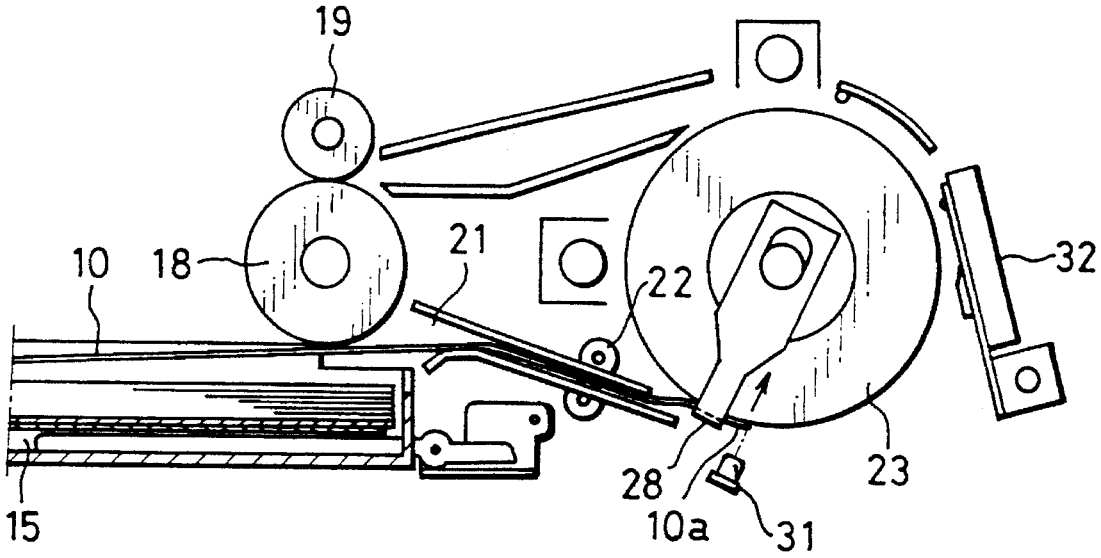
FIGS. 5A and 5B are explanatory views illustrating steps of clamping an advancing edge, and mounting the recording sheet on a platen drum.

The recording sheets 10 are lifted by the lifting lever 20 in response to a sheet feeding signal. As illustrated in FIG. 4C, the uppermost recording sheet 10 contacts the feeding/exiting roller 18, which moves it into the feeding path 21. The advancing rollers 22 advance the recording sheet 10 toward the platen drum 23. The advancing edge 10*a*, having passed the light-colored clamper 28, is detected by the position sensor 31. In response to the detection, the lifting lever 20 is moved down as illustrated in FIG. 5A. The recording sheets 10 in the sheet cassette 15 are moved together away from the feeding/exiting roller 18.

The clamper 28 is returned by the actuation of the cam mechanism 29 to recover the initial position. The advancing edge 10*a* is now clamped by the clamper 28, as illustrated in FIG. 5A. After the clamping, the stepping motor 25 is driven to rotate the platen drum 23 and the advancing rollers 22. The recording sheet 10 is fitted on the drum face 23*a* around the platen drum 23.

Figure 5B:
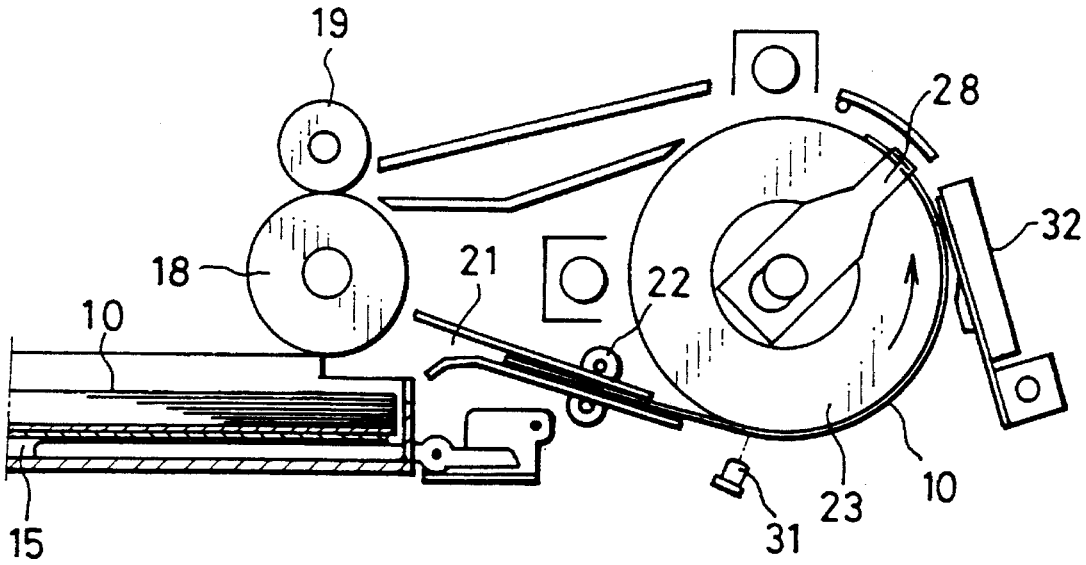

In the course of the rotation of the platen drum 23, the recording sheet 10 comes to the recording station. Prior to the start of the thermal recording, it is checked at the position sensor 31 whether the recording sheet 10 is present in the recording station. If it is judged that the recording sheet 10 is present, then the thermal head 32 is pressed against the recording sheet 10 as soon as an edge of an effective area 10*c* comes to lie under the thermal head 32, as illustrated in FIG. 5B.

The thermal head 32 is pressed on the recordable face by operation of the shifting mechanism 30, and thermally records the yellow color to the yellow coloring layer line after line. When the effective area 10*c* after the recording comes under the yellow fixing device 33, the ultraviolet lamp is driven to apply ultraviolet rays of 420 nm to the effective area 10*c* for the yellow fixation. When a rear edge of the effective area 10*c* comes to lie under the thermal head 32, the thermal head 32 is swung and shifted away from the recording sheet 10.

The yellow color is recorded and fixed in the yellow coloring layer of the recording sheet 10. The platen drum 23 with the recording sheet 10 has made one rotation. A front edge of the effective area 10*c* comes again to lie under the thermal head 32. The thermal head 32, having shifted away from the recording sheet 10, is shifted and pressed against the recording sheet 10. The magenta color starts being recorded to the magenta coloring layer. When the recording to the magenta coloring layer is ended, the thermal head 32 is shifted away from the recording sheet 10. The magenta fixing device 34 is driven to apply ultraviolet rays of 365 nm to the effective area 10*c* for the magenta fixation. Afterwards the cyan color is recorded in the cyan coloring layer, to terminate the three-color thermal recording in frame-sequential fashion.

The platen drum 23 makes three rotations. An exiting station detecting sensor (not shown) detects the clamper 28 coming to the exiting station. In response to this, the stepping motor 25 is stopped. The cam mechanism 29 is actuated to open the clamper 28. The advancing edge 10*a* is released from being clamped. Then the platen drum 23 restarts rotation. The clamper 28 is blocked by the stopper 40, and hindered from further rotation. The thermal head 32 still presses the recording sheet 10 against the platen drum 23. The recording sheet 10 is rotated with the platen drum 23, and moved through the clamper 28, separated by a separating edge of the exit path 37, and moved into the exit path 37. The recording sheet 10 is nipped by the feeding/exiting roller 18 and the exiting roller 19, and exited to the exit port 39.

Figure 6A:
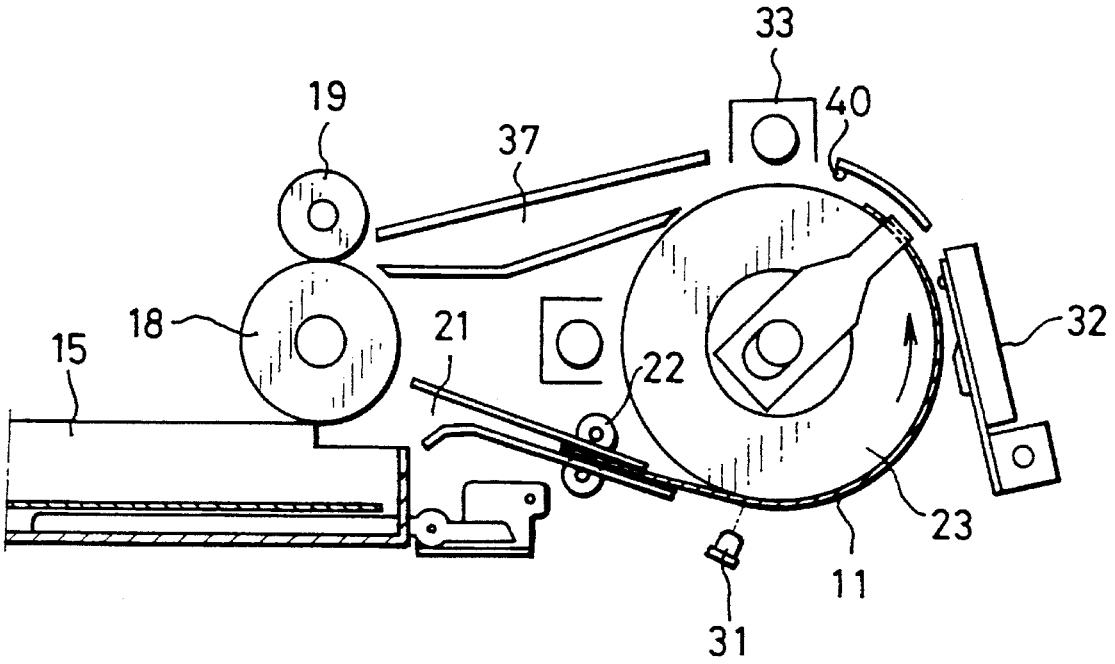
FIGS. 6A and 6B are explanatory views illustrating steps of detecting and exiting the protective sheet.
Figure 6B:
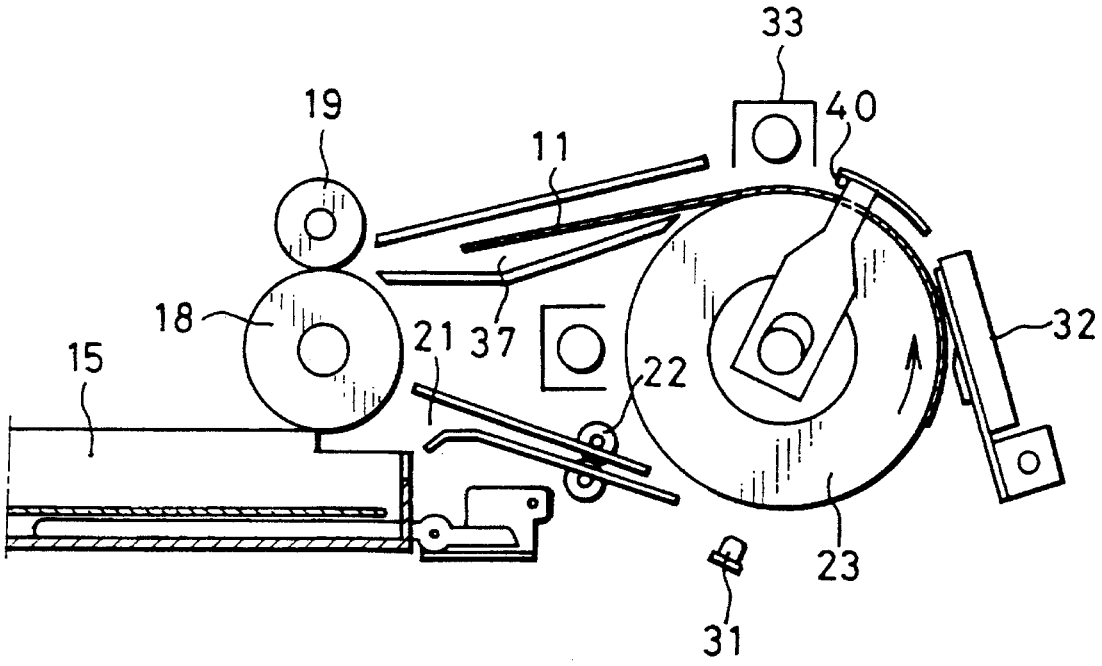

In checking of the sheet at the position sensor 31, if it is judged that the position sensor 31 remains off, it implies that the discriminative mark 13 of the protective sheet 11 is located at the position sensor 31, as illustrated in FIG. 6A. Then the printer operates for the protective sheet 11 to rub and clean the thermal head 32 while exited. When the platen drum 23 comes to the position of FIG. 6B, then the platen drum 23 is stopped. The clamper 28 is opened similarly to the above. The thermal head 32 is pressed against the protective sheet 11.

The platen drum 23 is rotated again. The protective sheet 11 is being pressed by the thermal head 32 against the platen drum 23, so that the protective sheet 11 rotates with the platen drum 23. The protective sheet 11 is passed through the clamper 28 having the open state, moved to the exit path 37, and exited to the exit port 39 by cooperation of the feeding/exiting roller 18 and the exiting roller 19 (See FIG. 6B).

Figure 7:
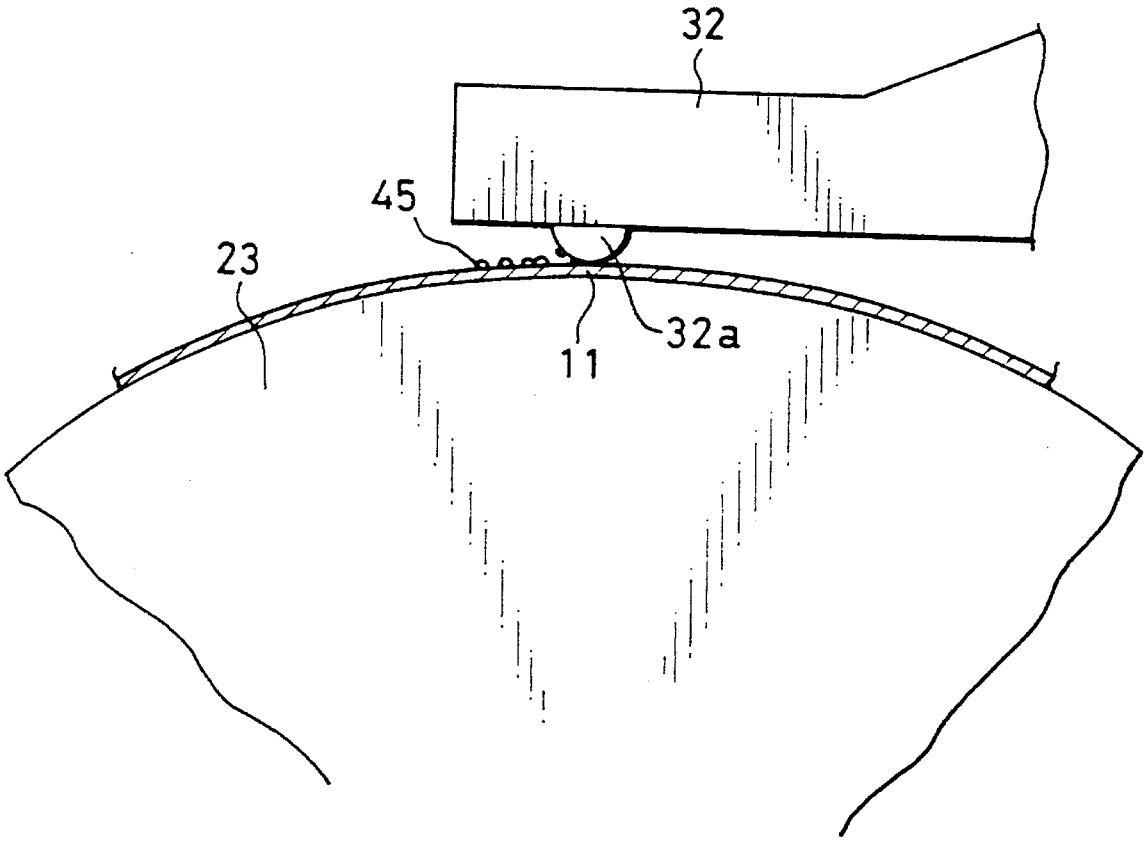
FIG. 7 is an explanatory view in side elevation, illustrating operation of cleaning the thermal head.
Figure 8:
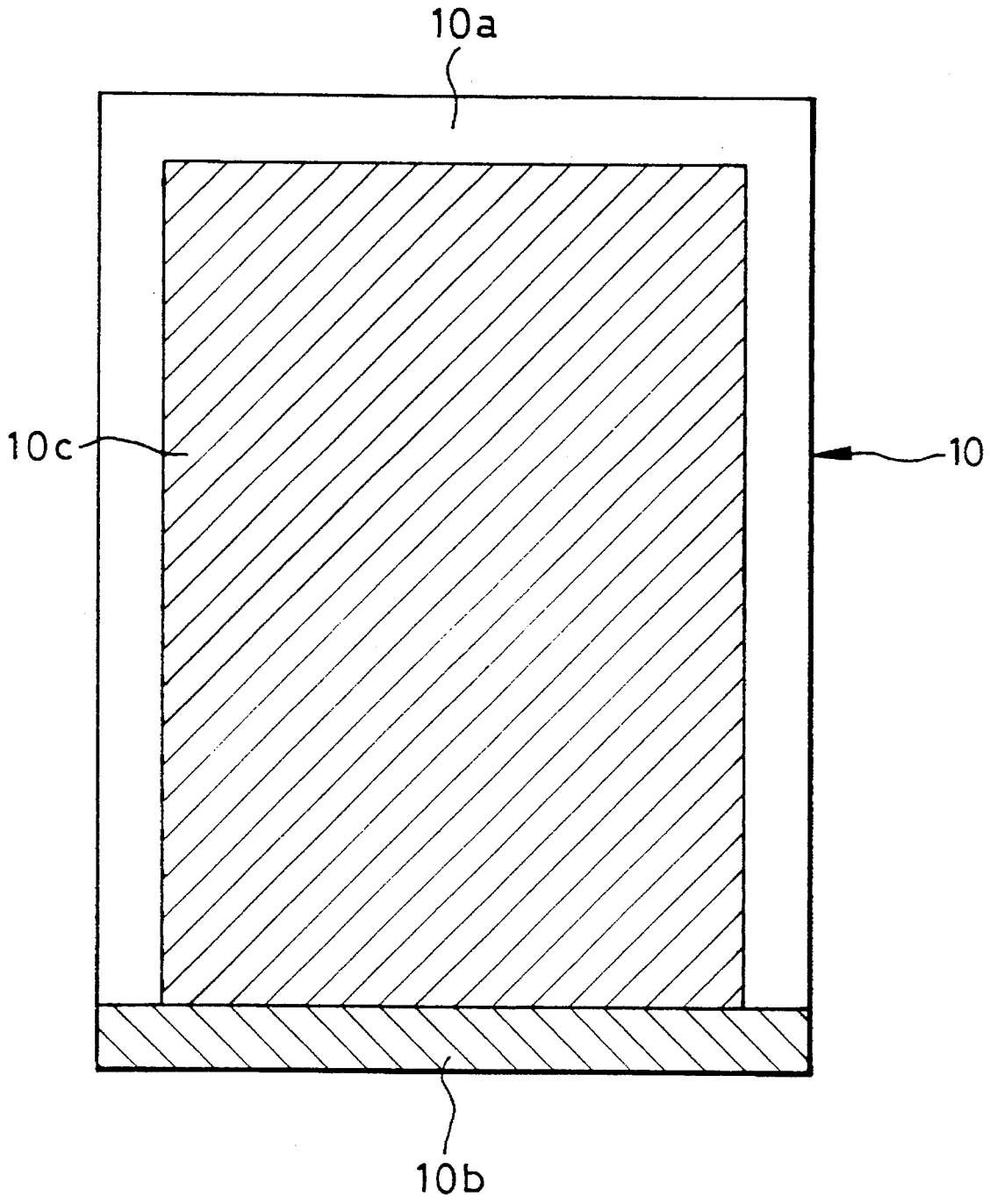
FIG. 8 is an explanatory view in top plan, illustrating each recording sheet.

In exiting of the protective sheet 11, the thermal head 32 is pressed against the protective sheet 11, with all its heating elements 32*a* driven for heating (See FIG. 7). In rubbing the heating elements 32*a*, the protective sheet 11 comes to have frictional force with the thermal head 32. Dust 45, having been stuck on the heating elements 32*a*, is wiped away and eliminated by the protective sheet 11. The thermal head 32 is generating heat so that the dust 45 softened by heat can be completely eliminated. Note that the cleaning operation with the protective sheet 11 is continued until a rear edge of the protective sheet 11 is moved past the thermal head 32. It is also possible to continue the cleaning operation until movement of a position in the protective sheet 11 which would correspond to a rear edge of the effective area 10*c* in the recording sheet 10.

In the above embodiment, the thermal head 32 is wiped by use of the protective sheet 11. Alternatively, a marginal area 10*b* of the recording sheet 10 can be used for wiping the thermal head 32. In operation of printing the yellow, magenta and cyan colors, the thermal head 32 is pressed on the effective area 10*c*. Even after passage of the rear edge of the effective area 10*c* under the thermal head 32, the thermal head 32 is continuously pressed against the recording sheet 10, and wiped by the marginal area 10*b* until passage of the whole of the recording sheet 10. During the contact of recording sheet 10 and the thermal head 32, the thermal head 32 is driven to have temperature lower than temperature starting coloring any of the yellow, magenta and cyan coloring layers.

Figure 9:
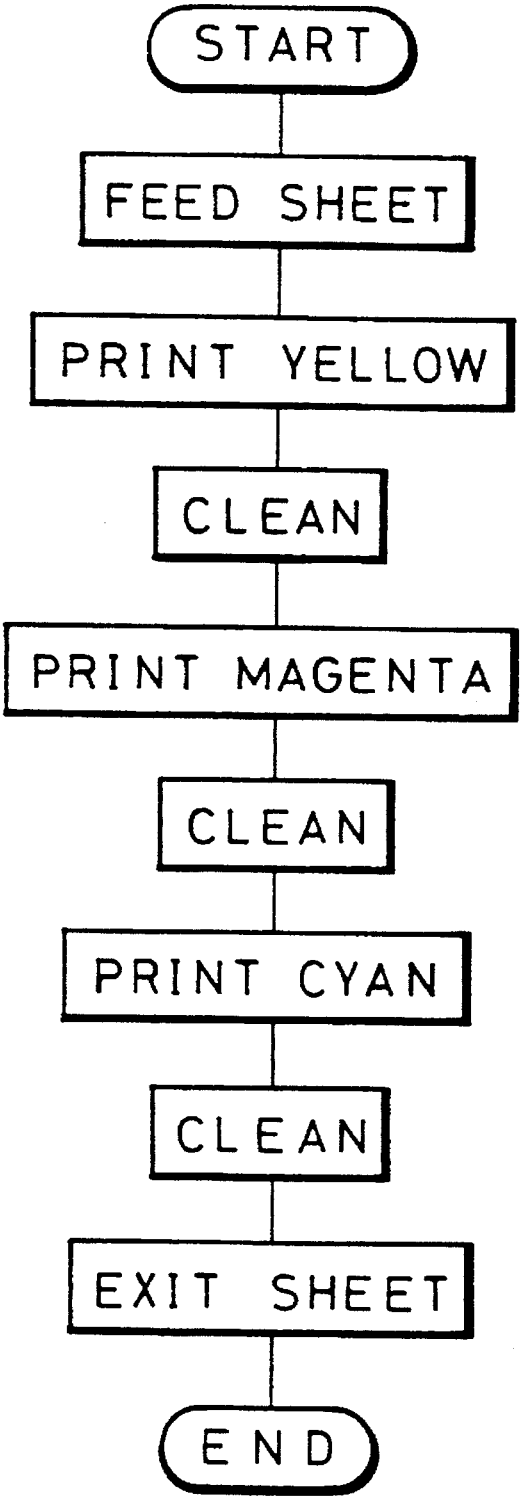
FIG. 9 is a flow chart illustrating a sequence of cleaning the thermal head with a marginal area in the recording sheets.

As illustrated in FIG. 9, the thermal head 32 is cleaned three times in printing of the single recording sheet 10. The marginal area 10*b* is contacted to wipe away the dust 45. The recording sheet 10 is never remarkably dirtied even with the cleaning operation, because the cleaning operation is so frequent with the printing operation that each recording sheet 10 is provided only with a small amount of the dust 45.

In the embodiment, after recording of the image, the recording sheet 10 is moved after the recording, with the thermal head 32 pressed against the recording sheet 10. The thermal head 32 is shifted away from the recording sheet 10 at the same time as the thermal head 32 confronts a rear edge of the recording sheet 10. Note that it is further preferable that the thermal head 32 is shifted away from the recording sheet 10 earlier than the thermal head 32 confronts a rear edge of the recording sheet 10.

In the above embodiments, the thermal head is driven to apply heat in the wiping operation of the thermal head. The present invention is also applicable to wiping operation of the thermal head without application of any heat. If the thermal head is not driven in the second of the above embodiments, the recording sheet can be used for elimination of the dust stable to heat, as the frictional force between the thermal head and the recording sheet is higher.

Any of the above embodiments is related to the line printer for a multi-color image. Alternatively the present invention is applicable to a serial printer in which the lines are recorded in course of movement of a thermal head. The present invention is also applicable to a monochromatic thermal printer. In the above embodiment, only the one protective sheet 11 is placed on the bottom of the sheet cassette 15 and under the stacked recording sheets 10. It is possible to place another protective sheet on the top of the stacked recording sheets 10, for the purpose of further protection of the recording sheets 10.

The present invention is applicable to a thermal printer in which a color thermosensitive recording sheet is reciprocally moved instead of being rotated for full color printing. For the reciprocation, it is possible to dispose a platen roller or plate having a small size for supporting the recording sheet, and pairs of transport rollers located upstream and downstream of said platen for moving the recording sheet reciprocally.

The present invention is also applicable to a thermal printer having three thermal heads, respectively for the yellow, magenta and cyan colors. The recording sheet on the platen drum can be colored for the full color printing only by one rotation of the platen drum (so-called "one-pass type").

The present invention is of course applicable to a three-head/one-pass thermal printer as disclosed in U.S. Pat. No. 4,734,704, which has three thermal heads, three platen rollers and transport rollers, and in which a recording sheet is caused to make only one straight passage to record three colors.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A method of cleaning a thermal head in a thermal printer comprising the steps of:

advancing a protective sheet out of a sheet cassette containing plural thermosensitive recording sheets and at lease one protective sheet in said sheet cassette;

moving said protective sheet to a printing station in said thermal printer;

heating said protective sheet with said thermal head pressed against said protective sheet while said protective sheet is moved past said printing station, to remove dust from said thermal head with said protective sheet; and moving said protective sheet past said printing station to exit said protective sheet from out of said thermal printer, without use of said protective sheet for printing.

2. A thermal head cleaning method as defined in claim 1, wherein said plural recording sheets have recordable and nonrecordable obverse faces and wherein said obverse faces are stacked in a same direction.

3. A thermal head cleaning method as defined in claim 2, wherein said protective sheet covers a recordable obverse face of the first of said plural thermosensitive recording sheets as viewed from the recordable obverse face of said sheets.

4. A method of cleaning a thermal head, comprising the steps of:

pressing said thermal head against a thermosensitive recording sheet while said recording sheet is moved;

driving said thermal head, for recording an image in an effective area on said recording sheet; and after recording of said image, moving said recording sheet with said thermal head pressed against a marginal area (10*b*) of said recording sheet, said marginal area defined between effective area and a rear edge of said recording sheet, said moving of said recording sheet relative to said pressed thermal head causing friction due to the movement of said sheet against said pressed thermal head, said friction from said moving recording sheet removing dust from said thermal head onto said recording sheet, said thermal head shifted away from said recording sheet before said thermal head confronts a rear edge of said recording sheet.

5. A method of cleaning a thermal head in a thermal printer having a sheet cassette set in said thermal printer, said sheet cassette containing plural stacked thermosensitive recording sheets, said recording sheets advanced one after another out of said sheet cassette toward a platen, said platen moved during thermal printing with said recording sheet supported thereon, wherein during thermal printing said platen is moved, said thermal head presses and heats said recording sheet to record an image on said recording sheet, said thermal head cleaning method comprising the steps of:

laying a protective sheet on said stacked recording sheets in said sheet cassette, said protective sheet protecting said recording sheets;

advancing said protective sheet out of said sheet cassette to said platen;

pressing said thermal head against said protective sheet set on said platen;

while said protective sheet is pressed, generating heat energy through said thermal head; and while said protective sheet is pressed, driving said platen for moving said protective sheet relatively to said thermal head, to remove dust from said thermal head with said protective sheet.

6. A thermal head cleaning method as defined in claim 5, wherein said protective sheet is advanced to said platen after a final one of said recording sheets is advanced.

7. A thermal head cleaning method as defined in claim 6, wherein said plural stacked recording sheets have optical fixability to electromagnetic rays and have recordable and nonrecordable obverse faces, and are so stacked as to direct said recordable obverse faces thereof in the same direction under said protective sheet.

8. A thermal head cleaning method as defined in claim 7, further comprising steps of:

retracting said thermal head from said platen after said thermal head is cleaned; and while said thermal head is retracted, driving said platen for moving said protective sheet past said thermal head, to exit said protective sheet from out of said thermal printer.

9. A thermal head cleaning method as defined in claim 8, wherein said platen is a rotatable platen drum of which said recording sheets and said protective sheet are respectively mounted on a periphery, and said thermal head is disposed linearly substantially along a shaft of said platen drum.

10. A thermal head cleaning method as defined in claim 9, further comprising steps of:

providing said protective sheet with at least one discriminative indicia on a face thereof opposite to said recording sheets, for signaling information of said protective sheet;

detecting in a detecting station whether said discriminative indicia is on one sheet mounted on said platen; and when said discriminative indicia is detected on said one sheet in said detecting station, determining said one sheet as said protective sheet, to clean said thermal head with said protective sheet without executing said printing step.

11. A thermal head cleaning method as defined in claim 10, wherein said discriminative indicia is disposed away from an advancing edge included in said protective sheet and directed ahead when advanced.

12. A thermal printer, comprising:

a sheet cassette for holding plural stacked recording sheets, and a protective sheet laid on said stacked recording sheets for protecting said recording sheets, said sheet cassette being operatively connected with said thermal printer;

a movable platen on which a thermosensitive sheet is set;

an advancing device for advancing said recording sheets and said protective sheet one after another out of said sheet cassette toward said platen;

a thermal head, disposed to confront said platen, for applying heat energy to said recording sheet set on said platen;

a shifter device for shifting said thermal head toward said platen, to press said thermal head against said recording sheet or said protective sheet; and a control device for controlling said shifter device, said advancing device, said thermal head and said platen during printing and cleaning, said control device causing said advancing device during cleaning to advance said protective sheet out of said sheet cassette to said platen, wherein said thermal head during cleaning generates heat energy while said shifter device presses said thermal head against said protective sheet, and driving said platen while said thermal head is pressed, for moving said protective sheet relatively to said thermal head, to remove dust from said thermal head with said protective sheet.

13. A thermal printer as defined in claim 12, wherein said protective sheet is advanced to said platen after a final one of said recording sheets is advanced.

14. A thermal printer as defined in claim 13, wherein said plural stacked recording sheets have optical fixability to electromagnetic rays, and are so stacked as to direct recordable obverse faces thereof to said protective sheet.

15. A thermal printer as defined in claim 14, wherein said shifter device retracts said thermal head from said platen after said thermal head is cleaned; and while said thermal head is retracted, said control device drives said platen for moving said protective sheet past said thermal head, to exit said protective sheet from out of said thermal printer.

16. A thermal printer as defined in claim 15, wherein said platen is a rotatable platen drum of which said recording sheets and said protective sheet are respectively mounted on a periphery, and said thermal head is disposed linearly substantially along a shaft of said platen drum.

17. A thermal printer as defined in claim 16, wherein said protective sheet is provided with at least one discriminative indicia on a face thereof opposite to said recording sheets, for signaling information of said protective sheet;

further comprising a sensor device for detecting whether said discriminative indicia is on one sheet mounted on said platen; and wherein when said discriminative indicia is detected on said one sheet, said one sheet is determined as said protective sheet, to execute said cleaning step.

18. A thermal printer as defined in claim 17, wherein said discriminative indicia is disposed away from an advancing edge included in said protective sheet and directed ahead when advanced.

19. A method of cleaning a thermal head in a thermal printer, which comprises the steps of:

printing on a thermosensitive recording material with said thermal head, which is pressed against said thermosensitive recording material, wherein while said recording material is pressed, said recording material is moved relatively to said thermal head and said thermal head thermally records an image on said recording material, said image formed in an effective area (10*c*) on said recording material, and after recording of said image, moving said thermal head relatively to said recording material while said thermal head is pressed against a marginal area on said recording material, said marginal area defined outside said effective area, said marginal area being the area where dust is removed from said thermal head and for cleaning said thermal head, said moving of said thermal head relatively to said recording material causing friction due to the movement of said thermal head against said recording material, said friction from moving said thermal head relatively to said recording material physically removing dust from said thermal heat onto said recording material, said thermal head shifted away from said recording material before said thermal head confronts a rear edge of said recording material.

20. A thermal head cleaning method as defined in claim 19, further comprising the step of applying heat energy of a predetermined amount to said thermal head while said thermal head is pressing against said marginal area of said recording material, the amount of said heat energy being smaller than the amount of heat energy necessary for causing an image to appear on said recording material.

21. A thermal head cleaning method as defined in claim 20, wherein said recording material is a thermosensitive recording sheet.

22. A thermal head cleaning method as defined in claim 21, wherein said recording material is a color thermosensitive recording sheet, and includes a support and at least a first cyan coloring layer, a second magenta coloring layer, and a third yellow coloring layer, each of said coloring layer colored respectively in cyan, magenta and yellow colors, and ink dots of said colors recorded in a frame-sequential fashion serially from said third yellow coloring layer to said first cyan coloring layer; and said thermal head is pressed against said marginal area after recording to said third coloring layer, after recording to said second coloring layer, and after recording to said first coloring layer.

* * * * *